United States Patent [19]

Karpov

[11] Patent Number: 4,541,135

[45] Date of Patent: Sep. 17, 1985

[54] AIR MATTRESS

[76] Inventor: Victor Karpov, 6236 Kirby Downs, Memphis, Tenn. 38115

[21] Appl. No.: 600,458

[22] Filed: Apr. 16, 1984

[51] Int. Cl.[4] ..... A47C 27/08

[52] U.S. Cl. ..... 5/455; 5/458

[58] Field of Search ..... 5/455, 452, 458, 449, 5/441, 457; 297/DIG. 3

[56] References Cited

U.S. PATENT DOCUMENTS

| | | | |
|---|---|---|---|
| 624,638 | 5/1899 | Fournier | 5/458 |
| 779,576 | 1/1905 | Berryman | 5/455 |
| 1,282,980 | 10/1918 | Takach | 5/455 |
| 2,360,715 | 10/1944 | Perry | 5/458 |
| 2,997,100 | 8/1961 | Morris | 5/455 |
| 3,583,008 | 6/1971 | Edwards | 5/455 |
| 3,925,835 | 12/1975 | Pennington et al. | 5/452 |
| 4,100,635 | 7/1978 | Mitchell et al. | 5/452 |
| 4,181,990 | 1/1980 | Santo | 5/452 |
| 4,218,274 | 8/1980 | Mollura | 5/458 |
| 4,306,322 | 12/1981 | Young et al. | 5/449 |
| 4,328,599 | 5/1982 | Mollura | 5/458 |
| 4,371,999 | 2/1983 | Reid | 5/457 |

*Primary Examiner*—Alexander Grosz

*Attorney, Agent, or Firm*—Lalos, Leeds, Keegan, Marsh, Bentzen & Kaye; Lalos, Leeds, Keegan, Marsh, Bentzen & Kaye

[57] ABSTRACT

An air mattress including an inflatable compartment formed of flexible material and defined by a ceiling, a floor, end walls, and side walls extending between the end walls. The end and side walls interconnect the ceiling and the floor and form the side edges of the inflatable compartment. At least one inflatable tube extends about and connects to the side edges, and when inflated provides support for them. The inflatable tube has a divider wall through a cross-section thereof and an inflatable chamber generally opposite the divider wall. The divider wall and the chamber divide the inflatable tube into first and second opposed inflatable C-shaped side support tubes. The chamber has a main valve passing from the exterior to the interior of the chamber and first and second one-way valves passing from the interior of the chamber to the first and second C-shaped support tubes, respectively. The one-way valves are constructed such that, when air is forced through the main valve into the chamber and pressure builds in the chamber, air is forced through the first and second one-way valves thereby simultaneously inflating the first and second C-shaped support tubes. A plurality of expandable elastic spring members, such as rubber bands, rubber cables or the like, are positioned in a spaced arrangement in the inflatable compartment, and each extends between and is connected to the ceiling and the floor. The spaced elastic members are attached in a pattern in the inflatable compartment and provide a flotation effect when a person rests on the mattress, similar to that experienced with waterbeds, but without the disadvantages inherent in waterbeds.

12 Claims, 5 Drawing Figures

AIR MATTRESS

BACKGROUND OF THE INVENTION

This invention relates to mattresses used as sleeping beds or as cushions for seats, such as on chairs or in vehicles. It more specifically relates to fluid-filled mattresses.

In the past it is known to provide a mattress having a flotation effect, such as in conventional water mattresses or so-called waterbeds. The advantages of such waterbeds are legion such as in aiding persons with back problems by removing the pressure on their spine and more evenly distributing their weight when they lie down. Other advantages of waterbeds include relieving the pain of arthritis, preventing bed sores, minimizing sleeping disturbances, and making patients recovering from surgery more comfortable. Unfortunately, numerous problems are inherent with waterbeds. One of the main problems is that the waterbeds require roughly one ton of water to fill them, and this severely limits their application as where the underlying floor structure is not sufficient to support such great weight. Additionally, a bulky frame system must be provided in which the waterbed is seated. The water in the waterbed must also be cleaned periodically with chemicals to prevent the growth of algae. The waterbed also requires heaters to heat the water, even in the summer, and baffles positioned in the water to dampen the waves created when a person seats himself on the waterbed. It has also proven to be a burdensome procedure to fill and empty the waterbeds for transporting or storing them, and extensive water damage can be caused if the bed leaks. Also when a person sits on the edge of the waterbed, or air mattresses, the edges collapse under this concentrated weight and a side edge support system must be provided. This has usually been a foam or wood framing structure or tubing arrangement around the bed, each having disadvantages.

Accordingly, it is the principal object of the present invention to provide a novel type of mattress, which minimizes or eliminates the problems previously experienced with waterbeds.

Another object of the present invention is to provide a novel air mattress which has a flotation or "spring effect" when a person rests on it.

A further object of the present invention is to provide an improved mattress having a superior therapeutic support system which does not require the use of water.

A still further object of the present invention is to provide an improved support system for the perimeter edges of an air mattress which does not have any of the undesireable "bubbling-up" effects.

Another object of the present invention is to provide an inexpensive, lightweight, and easily transportable air mattress.

A further object of the present invention is to provide an improved air mattress which is easily inflatable and deflatable.

Other objects and advantages of the present invention will become more apparent to those persons have ordinary skill in the art to which the present invention pertains from the following description taken in conjunction with the accompanying drawings.

DESCRIPTION OF THE PREFERRED EMBODIMENT

Figure 1:
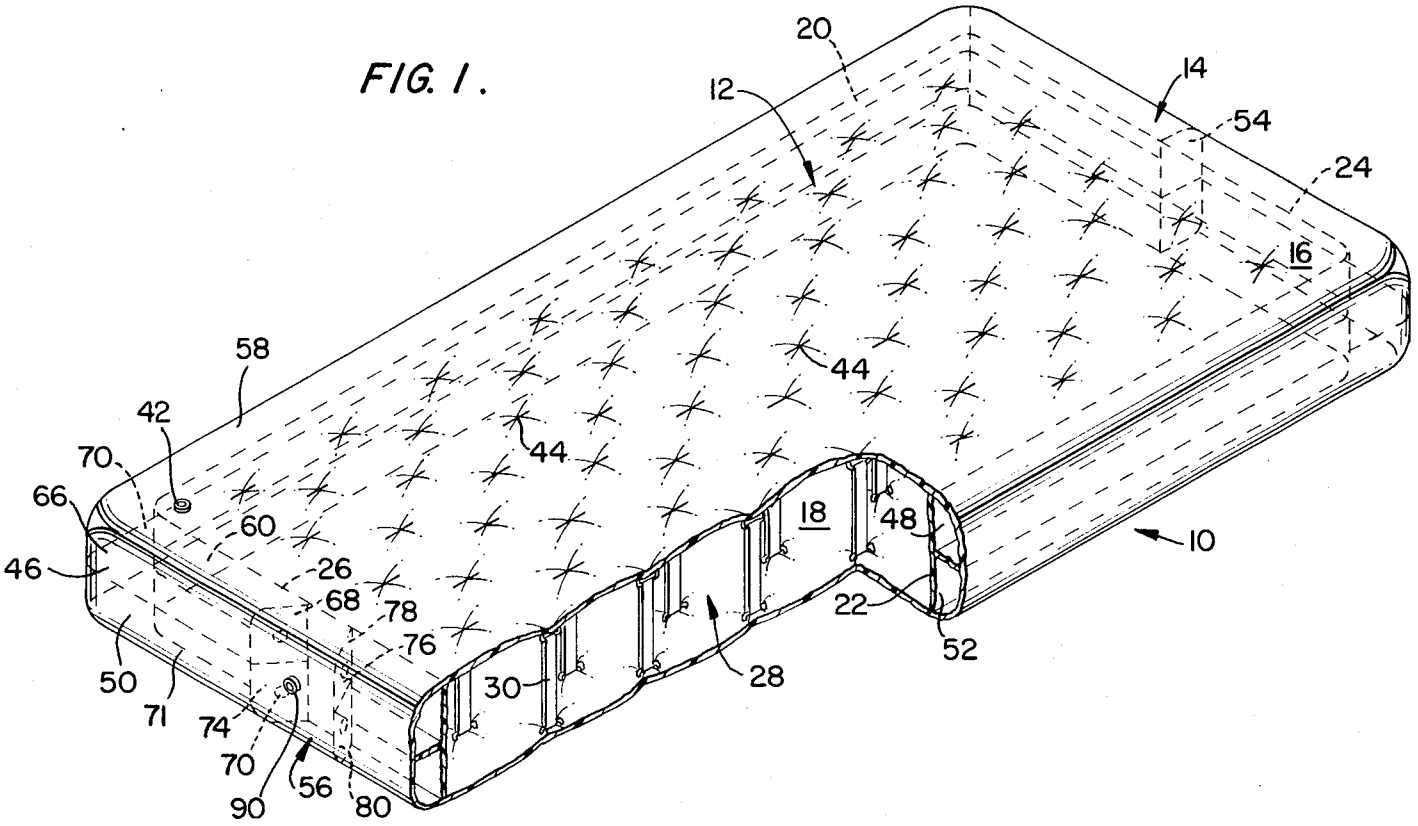
FIG. 1 is perspective view of an air mattress of the present invention with a portion thereof broken away for illustrative purposes.

Referring to FIG. 1, the preferred embodiment of the present air mattress invention is illustrated generally at 10, and can be dimensioned as an entire bed, a pillow or a seat cushion. Air mattress 10 includes an inner inflatable compartment shown generally at 12 and a support tube arrangement surrounding the perimeter of compartment 12 and illustrated generally at 14.

Figure 2:
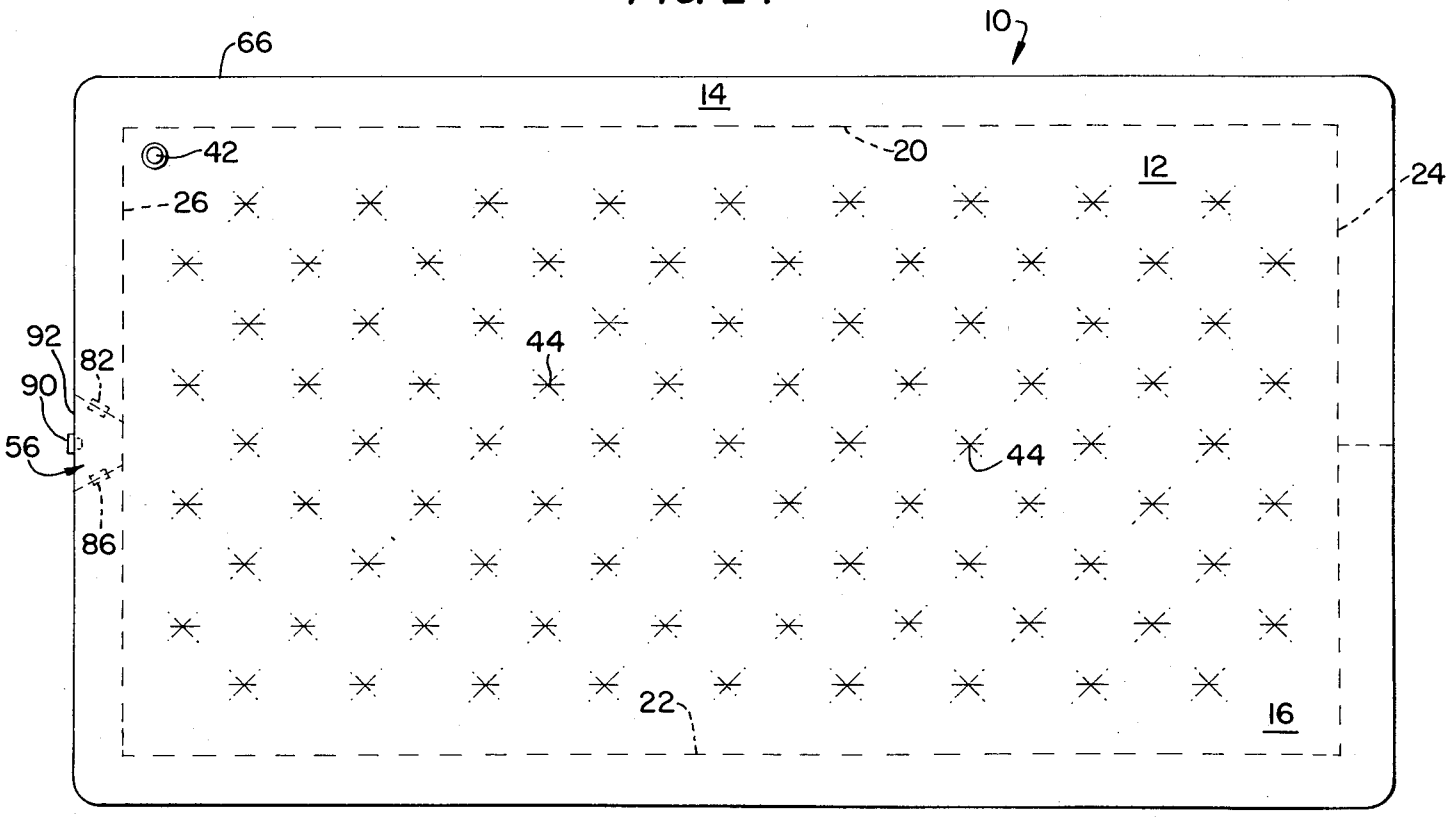
FIG. 2 is a top plan view of the air mattress of FIG. 1.
Figure 4:
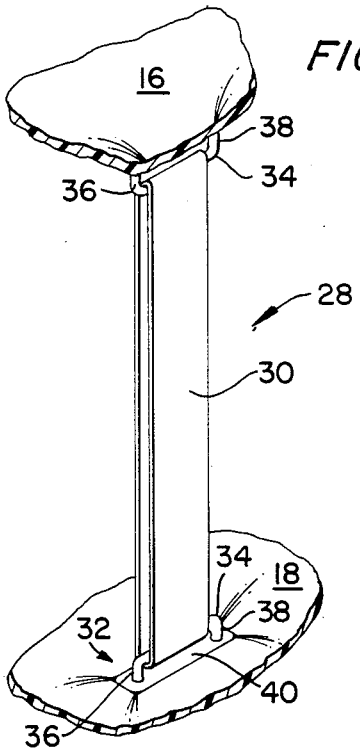
FIG. 4 is an enlarged perspective view of one of the elastic members of the air mattress of FIG. 1, illustrated in isolation.

Compartment 12 is defined by a ceiling 16, a parallel spaced floor 18, opposed spaced side walls 20 and 22, and opposed spaced end walls 24 and 26. The side and end walls interconnect the ceiling and floor and thereby define a rectangular inflatable compartment. Ceiling 16, walls 20, 22, 24 and 26 and floor 18 are made of any type of flexible material, such as vinyl or rubber. A plurality of elastic members shown generally at 28 in FIG. 1 extend between the floor and the ceiling. Referring to FIG. 4, elastic member 28 is shown to comprise an endless commercial rubber band 30, but other types of elastic members providing the present flotation or spring effect can be used as discussed later. Rubber band 30 is connected to the floor by any suitable attachment means 32. One such means is illustrated in FIG. 4 to comprise a clip 34 having two extending legs 36, 38 with rubber band 30 positioned therebetween. Extending legs 36, 38 are connected to a round, rigid or semi-rigid vinyl plate 40 which is then secured to the floor, by glue, heat sealing or any suitable securing means. An identical arrangement is provided for the connection of the rubber band 30 to the ceiling. The bands are adapted so that they are placed in tension when inflatable compartment 12 is inflated by blowing air through the air inlet 42 positioned at one corner of the inflatable compartment, as shown in FIGS. 1 and 2. The elastic members are thereby placed in tension causing a slight indentation in the outer surface of the ceilings and the floors, as shown by dimples 44 in FIGS. 1 and 2. The elastic members are spaced generally evenly across the surfaces of the ceiling and floor and preferably are arranged so as to define a diagonal pattern as best illustrated in FIG. 2. These spaced elastic members extending between the ceiling and the floor provide a soothing flotation effect when a person rests on air mattress 10 similar to that of waterbeds.

Figure 5:
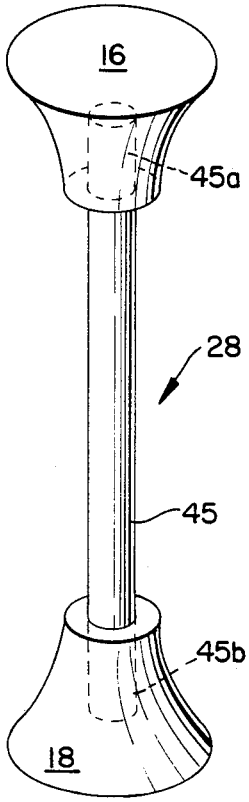
FIG. 5 is a view similar to FIG. 4 illustrating a second embodiment of the elastic member of the present invention.

A second, alternative means for forming elastic members 28 is illustrated in FIG. 5. Referring thereto, it is seen that a rubber cable 45 is provided in lieu of rubber band 30. Rubber cable 45 is attached at its upper end **45*a* to ceiling 16 and at its lower end 45*b* to floor 18. These ends are secured to their respective surfaces through a "rubber dipping" procedure and/or by suitable pins or nuts (not shown). Instead of these essentially one dimensional cables or bands, elastic member 28** can be formed by two-dimensional elastic, expandable cylinders or a series of spaced wall segments attached to and extending between the floor and the ceiling. It is further within the scope of the present invention for these cylinders to have holes passing through their sides so that the mattress can be easily and completely deflated. However, these alternative embodiments must be configured and formed of a suitable expandable material so as to provide the present desired soothing flotation or spring like effect.

Supporting tube arrangement 14 is shown in FIG. 1 to comprise four tubes 46, 48, 50 and 52 each being C-shaped. The first and second tubes 46 and 48 are positioned on top of the third and fourth tubes 50 and 52, respectively. The first and second tubes are divided by a divider wall 54 at one end and at the other end by an inflation chamber shown generally at 56 such that opposed C-shaped tubes 46, 48 are thereby defined. First tube 46 is defined by a ceiling 58 which is merely an extension of ceiling 16 of inflatable compartment 12, inner wall 60 which is merely the other side of the end and side walls of the inflatable compartment, divider wall 54, an outer wall 66, the wall 68 of chamber 56, and a floor 70. Similarly, third and fourth tubes 50 and 52 have general identical constructions as the first and second C-shaped tubes, but are positioned directly beneath them. For example, third C-shaped tube 50 is likewise defined by a floor 71 which is an extension of floor 18 of the inflatable compartment, an inner wall 60 which is the opposite side of the outer end and side walls of the inflatable compartment, an outer wall which is an extension of outer wall 66 of the first C-shaped support tube, a ceiling which is merely the lower side of floor 70 of the first C-shaped tube, and end chamber wall 72 which is an extension of wall 68. Another way to view supporting tube arrangement 14 is that it comprises a single tube extending about the entire perimeter and divided into four C-shaped tubes by divider wall 54, inflation chamber 56, and a horizontal plane (as shown by floor 70) passing through the tube.

Figure 3:
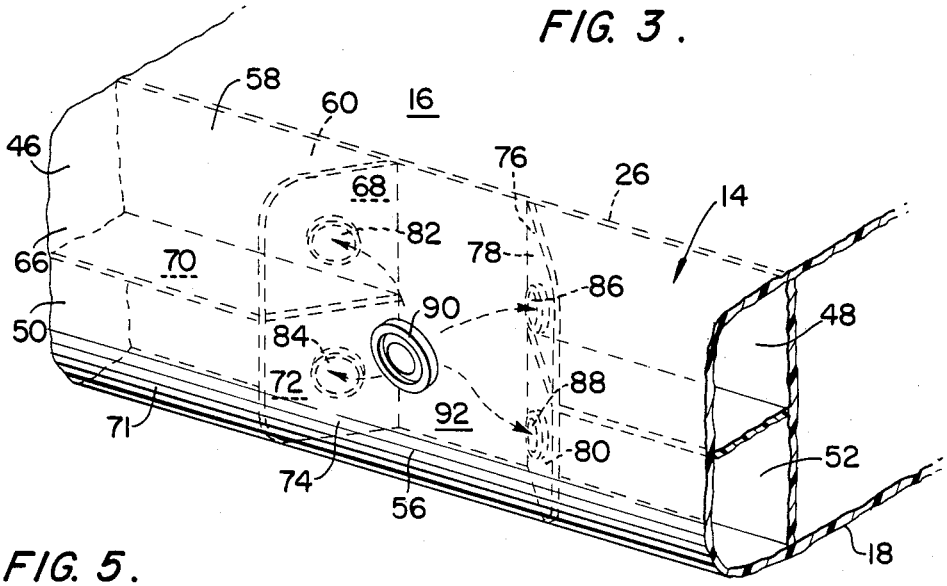
FIG. 3 is an enlarged perspective view of the valve means of the air mattress of FIG. 1, illustrated in isolation.

Inflation chamber 56 is best illustrated in FIG. 3, and, referring thereto, it is seen that it comprises a pair of converging walls 74 and 76 converging from the outside wall of the air mattress towards end wall 26 of the inflatable compartment. The two converging walls are divided into four sections 68, 72, 78 and 80, each having its own one-way valve 82, 84, 86, and 88, respectively, communicable with a separate C-shaped support tube. The one-way valves can be built by forming an opening in the wall of the tube through which air will be pumped and by attaching a vinyl disc that is larger than the hole to the inner tube side of the tube covering the hole. The disc is attached at numerous spaced attachment points about its perimeter to the inside tube wall. Air can then be pumped through the chamber, through the hole and against the disc. As the disc is pushed away from the tube, air passes between the attachment points into the tube, and when air is not pumped the disc lies flat against the tube thereby sealing the hole. Air valve 90 on outer wall 92, which wall is merely an extension of wall 66, communicates with the atmosphere and with the interior of inflatable chamber 56 and is positioned between the two converging walls. Thus, as is evident from the arrows in FIG. 3, an air pump is inserted into valve 90 and inflatable chamber 56 is inflated, and when the chamber reaches a certain pressure each of the valves 82, 84, 86 and 88 opens and the air is then forced into each of the C-shaped tubes, and the C-shaped tubes are thereby simultaneously inflated. Each of the valves is a one-way valve so that air does not freely pass from the C-shaped tubes through the valves into the chamber when pressure is exerted on the C-shaped tubes, as for example when a person sits or lies on the tubes. Additionally, the converging arrangement of walls 74 and 76 provides easy access to each of the valves for deflation. It is anticipated that a suitable, elongated instrument can be inserted through valve 90 separately into each of valves 82, 84, 86, and 88 through the chamber thereby opening the valves and deflating the associated C-shaped tube by gently applying pressure to the tube. These support tubes provide a superior perimeter edge support structure for the mattress than previously available.

From the foregoing detailed description, it will be evident that there are a number of changes, adaptations and modifications of the present invention which come within the province of those persons having ordinary skill in the art to which the aforementioned invention pertains. However, it is intended that all such variations not departing from the spirit of the invention be considered as within the scope thereof as limited solely by the appended claims.

I claim:

1. An air mattress comprising:

an inflatable compartment formed of flexible material and defined by a ceiling, a floor, first and second spaced parallel end walls, and first and second spaced parallel side walls extending between said first and second end walls, said end and side walls interconnecting said ceiling and said floor and forming the side edges of said inflatable compartment, and an inflatable tube extending about said side edges of said inflatable compartment, connected to each said side edge, and when inflated providing support for said side edges, said inflatable tube having a divider wall through a cross-section thereof and a chamber generally opposite said divider wall, said divider wall and said chamber dividing said inflatable tube into first and second opposed inflatable C-shaped support tubes, said chamber including a valve means from the exterior to the interior of said chamber and first and second one-way valves passing from the interior of said chamber to said first and second C-shaped support tubes, respectively, and constructed such that, when air is forced through said valve means into said chamber and pressure builds in said chamber, air is forced through said first and second one-way valves thereby simultaneously inflating said first and second C-shaped support tubes, and such that said first and second one-way valves prevent air from freely flowing out of said C-shaped support tubes into said chamber when pressure is applied to said first and second C-shaped support tubes.

2. The air mattress of claim 1 including, said first and second C-shaped support tubes being independently inflatable.

3. The air mattress of claim 1 including, a second inflatable tube positioned immediately beneath said inflatable tube, extending about the side edge perimeter of said inflatable compartment, connected to each said side edge, and providing additional support for said side edges, said second inflatable tube having a second divider wall through a cross-section of said second inflatable tube, and said chamber being generally opposite said second divider wall, said second divider wall and said chamber dividing said second inflatable tube into third and fourth opposed inflatable C-shaped support tubes, said third C-shaped support tube being positioned directly beneath said first C-shaped support tube and said fourth C-shaped support tube being positioned directly beneath second C-shaped support tube, said chamber communicating through said valve means with the exterior, said chamber further including third and fourth one-way valves passing from the interior of said chamber to said third and fourth C-shaped support tubes, respectively, and constructed such that, when air is forced through said valve means into said chamber, air is forced through said third and fourth one-way valves thereby simultaneously inflating said third and fourth C-shaped support tubes, and such that said third and fourth one-way valves prevent air from freely flowing out of said third and fourth C-shaped support tubes into said chamber.

4. The air mattress of claim 3 including, said chamber including an outer chamber end wall and said valve means extending through said outer chamber end wall, said chamber further including first and second side opposed chamber side walls generally perpendicular to said outer chamber end wall, said first and third valve means passing from the interior of said chamber through said first chamber side wall into said first and third C-shaped support tubes, respectively, and said second and fourth valve means passing from the interior of said chamber through said second chamber side wall into said second and fourth C-shaped support tubes, respectively.

5. The air mattress of claim 4 including, said first and second chamber side wall converging from said chamber end wall towards said inflatable compartment.

6. The air mattress of claim 4 including, said outer chamber end wall being parallel to said first end wall.

7. The air mattress of claim 3 including, said divider wall and said second divider wall being immediately adjacent and positioned in the same plane.

8. The air mattress of claim 1 including, said inflatable compartment being dimensioned to support a person seated on it.

9. The air mattress of claim 1 including, said inflatable compartment being dimensioned to support a person lieing on it.

10. An air mattress comprising:

an inflatable compartment formed of flexible material and defined by a ceiling, a floor, first and second spaced parallel end walls, and first and second spaced parallel side walls extending between said first and second end walls, said end and side walls interconnecting said ceiling and said floor and forming the side edges of said inflatable compartment, an inflatable tube extending about said side edges of said inflatable compartment, connected to each said side edge, and when inflated providing support for said side edges, said inflatable tube having a divider wall through a cross-section thereof and a chamber generally opposite said divider wall, said divider wall and said chamber dividing said inflatable tube into first and second opposed inflatable C-shaped support tubes, said chamber including a valve means for the exterior to the interior of said chamber and first and second one-way valves passing from the interior of said chamber to said first and second C-shaped support tubes, respectively, and constructed such that, when air is forced through said valve means into said chamber and pressure builds in said chamber, air is forced through said first and second one-way valves thereby simultaneously inflating said first and second C-shaped support tubes, and such that said first and second one-way valves prevent air from freely flowing out of said C-shaped support tubes into said chamber when pressure is applied to said first and second C-shaped support tubes, and a plurality of spaced expandable elastic members positioned in said inflatable compartment, each said elastic member extending between said ceiling and said floor and being connected at one end by a ceiling attachment means to said ceiling and at an opposite end by a floor attachment means to said floor, said inflatable compartment having an opening through which air can be forced into said inflatable compartment thereby inflating said inflatable compartment, and said elastic members being placed in tension when said inflatable compartment is inflated thereby providing a flotation effect when weight is placed on a portion of said ceiling.

11. The air mattress of claim 10 including, said first and second C-shaped support tubes being independently inflatable.

12. The air mattress of claim 10 including, a second inflatable tube positioned immediately beneath said inflatable tube, extending about the side edge perimeter of said inflatable compartment, connected to each said side edge, and providing support for said side edges, said second inflatable tube having a second divider wall through a cross-section of said second inflatable tube, and said chamber being generally opposite said second divider wall, said second divider wall and said chamber dividing said second inflatable tube into third and fourth opposed inflatable C-shaped support tubes, said third C-shaped support tube being positioned directly beneath of said first C-shaped support tube and said fourth C-shaped support tube being positioned directly beneath said second C-shaped support tube, said chamber communicating through said valve means with the exterior, said chamber further including third and fourth one-way valves passing from the interior of said chamber to said third and fourth C-shaped support tubes, respectively, and constructed such that, when air is forced through said valve means into said chamber, air is forced through said third and fourth one-way valves thereby simultaneously inflating said third and fourth C-shaped support tubes, and such that said third and fourth one-way valves prevent air from freely flowing out of said third and fourth C-shaped support tubes into said chamber.

* * * * *